US008314355B2

(12) United States Patent
Nagao et al.

(10) Patent No.: US 8,314,355 B2
(45) Date of Patent: Nov. 20, 2012

(54) GAS INSULATED BREAKING DEVICE

(75) Inventors: Eiichi Nagao, Tokyo (JP); Makiko Kawada, Tokyo (JP); Tadao Minagawa, Tokyo (JP); Ei Tsuchie, Tokyo (JP); Kyoichi Ohtsuka, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 132 days.

(21) Appl. No.: 11/436,545

(22) Filed: May 19, 2006

(65) Prior Publication Data

US 2006/0260678 A1 Nov. 23, 2006

(30) Foreign Application Priority Data

May 20, 2005 (JP) ..... 2005-147798
May 20, 2005 (JP) ..... 2005-147830

(51) Int. Cl.
*H01H 33/02* (2006.01)

(52) U.S. Cl. ..... 218/48; 218/65

(58) Field of Classification Search ..... 218/16–21, 218/48–65, 74

See application file for complete search history.

(56) References Cited

U.S. PATENT DOCUMENTS 2,504,906 A * 4/1950 Tremblay ..... 200/265
2,914,428 A * 11/1959 Ruckelshaus et. al. ..... 428/433
3,598,550 A * 8/1971 Takahashi et al. ..... 428/621
4,069,370 A * 1/1978 Harmsen et al. ..... 428/671
5,129,143 A * 7/1992 Wei et al. ..... 29/885
5,137,619 A * 8/1992 Moriki et al. ..... 205/179
5,849,424 A * 12/1998 Sugawara et al. ..... 428/674
6,211,478 B1 * 4/2001 Schoenemann et al. ..... 218/16
2003/0186597 A1 * 10/2003 Suzuki et al. ..... 439/886
2005/0196634 A1 * 9/2005 Abe et al. ..... 428/615

FOREIGN PATENT DOCUMENTS

JP 9-306326 11/1997
JP 2003-297199 A 10/2003
JP 2004-273155 A 9/2004

* cited by examiner

*Primary Examiner* — Amy Cohen Johnson
*Assistant Examiner* — Marina Fishman
(74) *Attorney, Agent, or Firm* — Buchanan Ingersoll & Rooney PC

(57) ABSTRACT

In a gas insulated breaking device which accommodates open/close elements including a puffer cylinder which compresses an insulation gas and extinguishes an arc and a contact finger which has a slide contact portion which is brought into slide contact with a slide contact portion of the puffer cylinder in the inside of a vessel in which the insulation gas is sealed, a relatively soft plating film is formed on the slide contact portion of the puffer cylinder, and a relatively hard plating film is formed on the slide contact portion of the contact finger, and the silver plating film of each slide contact portion has an inner layer thereof formed of a soft film and an outer layer thereof which constitutes a surface portion formed of a hard film.

9 Claims, 4 Drawing Sheets

GAS INSULATED BREAKING DEVICE

BACKGROUND OF THE INVENTION

1. Field of the Invention

The present invention relates to a gas insulated breaking device, and more particularly to silver plating which is formed on a slide contact portion with respect to a gas insulated breaking device which is used in a power transforming field of a power system.

2. Description of the Related Art

FIG. 1 is a side view showing the constitution of a puffer type gas insulated breaking device which includes an arc-extinguishing chamber of a two-directional blow method to which the present invention is applicable, and the basic constitution of the breaker has been well known as a related art.

In FIG. 1, the gas insulated breaking device is constituted of a grounded tank 12 in which a $SF_6$ gas 11 which constitutes an insulating medium is sealed and a manipulation housing 14 which accommodates a manipulation device 13 therein, wherein a manipulation force is transmitted through a shaft seal 15. A driving force of the manipulation device 13 is transmitted by way of an insulation manipulation rod 17 which is accommodated in the inside of an insulation support sleeve 16 which is arranged in the inside of the grounded tank 12, wherein a movable arc contact 18 and a movable contact 19 are respectively mechanically separated from a fixed arc contact 20 and a fixed contact 21 thus performing the current breaking.

To establish the electric connection between a puffer cylinder 1 and a finger contact 2, the finger contact 2 is configured to slide on a surface of the puffer cylinder 1. To realize a favorable electrically connected state, silver plating treatment is applied to a slide portion. When a silver plating film is erased due to a progress of wear of the silver plating by sliding, the contact resistance of the slide portion is increased thus giving rise to a possibility that heat attributed to Joule heat is generated along with the supply of electricity.

To enhance the lubricity of the slide portion thus suppressing the increase of the wear of the silver plating and the contact resistance, a lubrication material is applied to the silver plating (see, JP-A-9-306326, Movable Contact Device of Circuit Breakers) being published as patent document of Japan ((page 3, FIG. 4), for example).

As shown In FIG. 4 in JP-A-9-306326, silver plating 21 is applied to a surface of a movable contact 9 which constitutes a base material of a slide portion. Further, to enhance the lubricity of a slide portion, binder 22 made of perfluoropolyether and graphite 23 are used as lubrication materials. These lubrication materials possess heat resistance of 400° C. or more and hence, the binder 22 can firmly hold the graphite 23 thus maintaining the favorable lubricity.

With respect to the slide portion of the gas insulated breaker which includes a breaker portion to which these lubrication materials are applied, the same silver plating film is arranged on surfaces of the puffer cylinder and the finger contact. Further, to enhance the lubricity of the slide portion, the binder made of perfluoropolyether and the graphite are used as the lubrication material.

As described above, due to the advantageous effect of the lubrication materials applied to the slide portion, the wear of the silver plating is reduced thus providing the structure which prevents the increase of the contact resistance. However, it is impossible to completely suppress the wear and it is necessary to perform the silver plating treatment with plating thickness corresponding to the slide condition required by the device. When members having different hardnesses slide with each other, the wear of the soft member having the low hardness progresses, and the hard member having the high hardness is hardly worn.

In the slide portion of the conventional gas insulated breaker, the silver platings which are manufactured by the same process are applied to respective surfaces of the puffer cylinder and the finger contact. In general, however, plating treatments of both parts are processed with lots different from each other and hence, there arises difference in plating hardness between these silver platings although the difference is trivial. Since which one of the plating film of the puffer cylinder and the plating film of the finger contact assumes a larger value depends on the number of manufacturing lots, it is not always possible to choose one of them.

In the observation after carrying out a slide test, following two cases exist in a mixed form. That is, in the first case, the silver plating on the puffer cylinder side is remarkably worn, while the plating on the finger contact side is hardly worn, while in the second case, to the contrary, the silver plating on the finger contact side is remarkably worn and the plating on the puffer cylinder side is hardly worn. Which one of both parts exhibits more wear in silver plating depends on the hardnesses of plating films of both parts. Since the hardnesses depend on the number of manufacturing lots, when the slide portion of an arbitrarily gas insulated breaker is taken as an example, it is difficult to determine which one of the plating film of the puffer cylinder and the plating film of the finger contact exhibits more hardness.

Accordingly, in the slide portion of the conventional gas insulated breaker, to prevent the increase of the contact resistance even when the plating film of either one of the puffer cylinder and the finger contact is worn, silver plating treatment of the same thicknesses is applied to both sides.

However, the part which is worn in an actual apparatus is either one of the plating film of the puffer cylinder and the plating film of the finger contact and hence, there has been a drawback that another plating film possesses an unnecessarily large thickness.

Further, as described above, the silver plating is required to satisfy functions which are contradictory to each other, that is, the realization of the favorable electrical contact state and the maintenance of the favorable slide state. While the realization of the favorable electrical contact requires the reduction of the contact resistance, the soft plating film is suitable for the realization of this function.

FIG. 3 is a schematic view which depicts the contact state of the slide portion microscopically. In general, when two surfaces are brought into contact with each other, fine projections which are present on the respective surfaces are brought into contact with each other and these fine projections are subject to the plastic deformation in response to pressing. The magnitude of the plastic deformation is controlled by a pressing pressure and hardnesses of members which are brought into contact with each other, wherein the plastic deformation of the soft film is larger than the plastic deformation of the hard film and a contact area of the soft film becomes larger than a contact surface of the hard film. Since the contact resistance is controlled by the contact area, the contact resistance of the soft film having the large contact area is decreased.

On the other hand, with respect to the sliding, the hard film is advantageous to the contrary. The reason that the silver plating is used in the slide portion of the gas insulated breaking device is that the silver plating film is originally soft and hence, is subject to large plastic deformation when the film is pushed whereby it is possible to expect an advantageous effect that the contact resistance is reduced.

Although the silver plating is worn due to the sliding between the puffer cylinder 1 and the finger contact 2, a wear quantity is generally controlled by hardness. That is, the harder the film, the wear quantity is decreased. Accordingly, when the silver plating is formed of the soft film, the wear attributed to sliding is increased and hence, there arises a drawback that it is necessary to preliminarily increase the thickness of the silver plating film and, at the same time, the worn powder constitutes metal foreign substances and lowers the insulation performance of the apparatus.

To the contrary, when the silver plating is formed of the hard film, although the wear quantity can be reduced, the contact resistance is increased. By applying the lubrication material which is constituted of the binder made of perfluoropolyether and graphite described as the related art to the soft film, it is possible to expect an advantageous effect to reduce the wear quantity to an extent. However, compared to the hard film, the wear quantity is still large and hence, the wear quantity reduction effect is not less than optimum.

Here, the soft film and the hard film, in general, correspond to the presence or the non-presence of a gross agent. In case of the silver plating having the basic composition, non-gross silver plating which is formed of the soft film is used. However, in case of the silver plating which uses following gross agents (1) to (7) listed below which are described in table 2. 70 on page 354 of "Hyomen Gijutsu souran, —mekki•youkyokusankahen— (book on surface technology-plating and anodization—)", original version, Koshinsha Co., Ltd. Jun. 15, 1983, which is a non-patent document, due to the suppression of an electrochemical reaction attributed to the addition of a gross agent, the crystalline structure of silver is finely granulated and hence, a degree of surface smoothness is enhanced whereby the grossness is obtained. Since added substances and hydrogen are precipitated as impurities in grain boundaries of fine crystals, the hard plating film is obtained.

(1) condensation product of carbon dioxide and ketones
(2) xanthic salt
(3) ASK compound (acrolein-sulfur disulfide condensation product)
(4) thiocarbazide condensation product
(5) thio sulfate
(6) selenium and tellurium compound
(7) antimony-bismuth compound

SUMMARY OF THE INVENTION

The present invention has been made to overcome the above-mentioned drawbacks and it is an object of the present invention to optimize a measure to cope with wear by constituting a silver plating film which is formed on a slide contact portion of a puffer cylinder and a silver plating film which is formed on a slide contact portion of an electricity supply means which supplies electricity to the puffer cylinder using plating films having hardnesses different from each other.

Further, it is another object of the present invention to acquire a gas insulated breaking device provided with slide contact portions which can realize a favorable electrical contact state and, at the same time, can maintain a favorable slide state.

In a gas insulated breaking device according to the present invention which accommodates open/close elements including a puffer cylinder which compresses an insulation gas and extinguishes an arc and an electricity supply means which has a slide contact portion which is brought into slide contact with a slide contact portion of the puffer cylinder in the inside of a vessel in which the insulation gas is sealed, silver plating films which are formed on the slide contact portion of the puffer cylinder and the slide contact portion of an electricity supply means are constituted of plating films which have hardnesses different from each other.

Further, in the gas insulated breaking device which accommodates open/close elements of a breaker portion having a slide contact portion in the inside of a vessel in which an insulation gas is sealed, a silver plating film which is formed in the slide contact portion is constituted of a plurality of plating films which differ in hardness.

According to the present invention, by constituting the silver plating film which is formed in the slide contact portion of the puffer cylinder and the silver plating film which is formed on the slide contact portion of the electricity supply means which supplies electricity to the puffer cylinder using the plating films having hardnesses different from each other, it is possible to provide the gas insulated breaking device which can optimize the measure to cope with a wear.

According to the present invention, it is possible to obtain a gas insulated breaking device which can realize the favorable electrical contact state and, at the same time, can maintain the favorable slide state.

The foregoing and other objects, features, aspects and advantages of the present invention will become more apparent from the following detailed description of the present invention when taken in conjunction with the accompanying drawings.

DETAILED DESCRIPTION OF THE INVENTION

Embodiment 1

Figure 1:
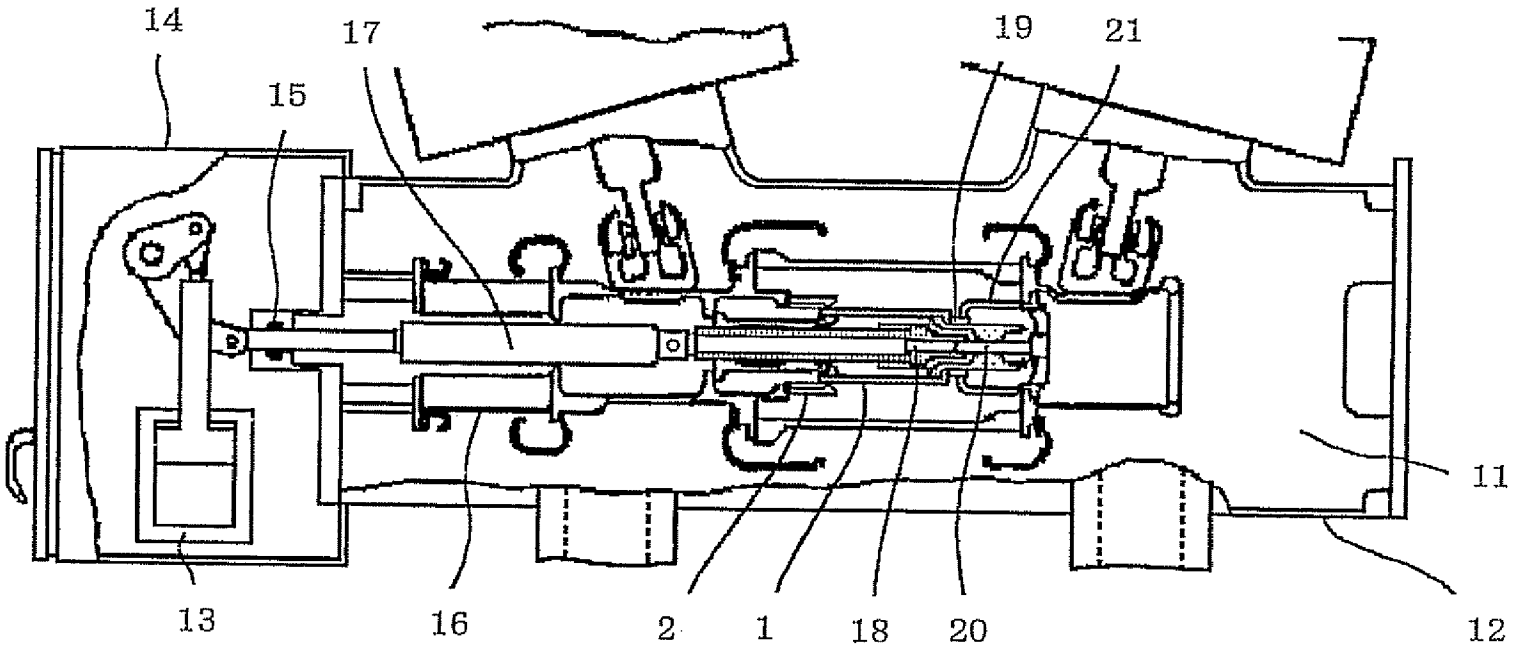
Fig. 1 RELATED ART
FIG. 1 is a side view showing one example of a puffer type gas insulated breaker which includes an arc-extinguishing chamber of a two-directional blow method to which the present invention is applied.
Figure 2:
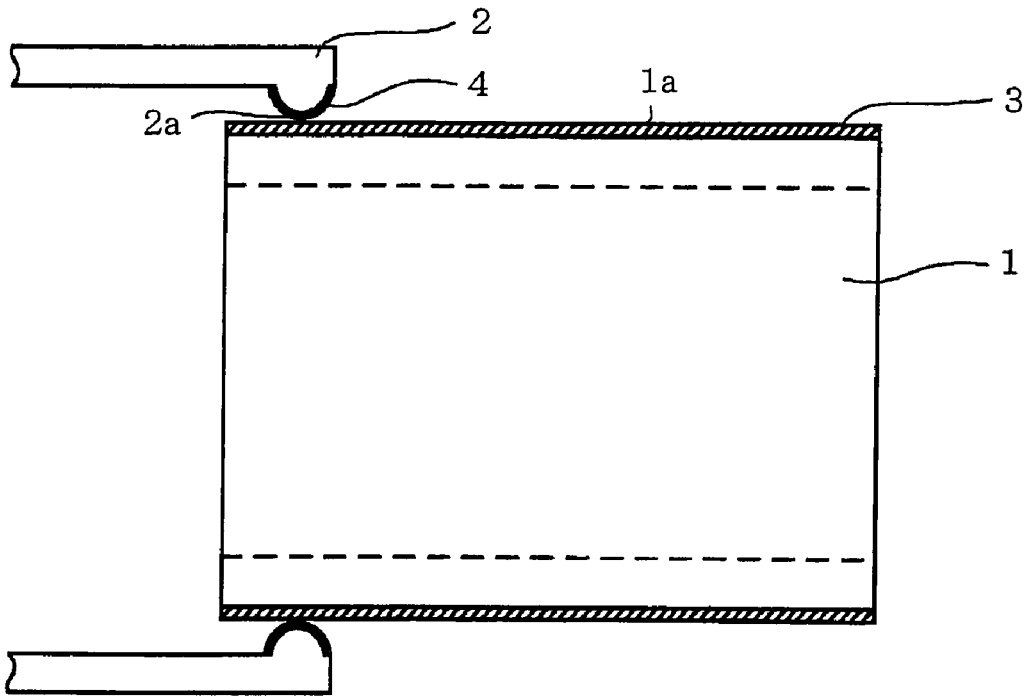
FIG. 2 is a cross-sectional view showing one example of the constitution of a slide portion of a gas insulated breaker according to the first embodiment of the present invention.

An embodiment 1 according to the present invention is explained in conjunction with FIG. 1 and FIG. 2. FIG. 1 is a side view showing one example of a puffer type gas insulated breaker which includes an arc-extinguishing chamber of a two-directional blow method to which the embodiment 1 of the present invention is applied. FIG. 2 is a cross-sectional view showing one example of the constitution of a slide portion of a gas insulated breaker according to the first embodiment of the present invention. Here, in FIG. 1 and FIG. 2, same symbols indicate identical parts.

In FIG. 1 which shows one example of the puffer type gas insulated breaker which includes the arc-extinguishing chamber of the two-directional blow method to which the present invention is applied, the gas insulated breaking device is constituted of a grounded tank 12 in which a $SF_6$ gas 11 which constitutes an insulating medium is sealed and a manipulation housing 14 which accommodates a manipulation device 13 therein, wherein a manipulation force is transmitted through a shaft seal 15. A driving force of the manipulation device 13 is transmitted by way of an insulation manipulation rod 17 which is accommodated in the inside of an insulation support sleeve 16 which is arranged in the inside of the grounded tank 12, wherein a movable arc contact 18 and a movable contact 19 are respectively mechanically separated from a fixed arc contact 20 and a fixed contact 21 thus performing the current breaking. The puffer cylinder 1 moves in the direction that the puffer cylinder 1 is separated from the fixed arc contact 20 together with the movable arc contact 18 thus compressing the $SF_6$ gas 11 which constitutes an extinguishing medium in the inside of the puffer cylinder 1 whereby the $SF_6$ gas 11 is blown to the arc so as to perform an extinguishing function.

To establish the electric connection between the puffer cylinder 1 which moves together with the movable arc contact 18 and the finger contact 2 which is formed on a fixing portion, the finger contact 2 is configured to slide on a surface of the puffer cylinder 1. To realize a favorable electrically connected state, the silver plating treatment is applied to a slide portion.

In FIG. 1 which shows the constitution of a slide portion of the gas insulated breaker according to the embodiment of the present invention, a slide contact portion 1*a* of the puffer cylinder 1 and a slide contact portion 2*a* of the finger contact 2 are shown.

In FIG. 2, a soft silver plating film 3 is formed on the surface of the puffer cylinder 1 and a hard silver plating film 4 is formed on the surface of the finger contact 2.

The puffer cylinder 1 is generally made of aluminum, and the soft silver plating film 3 which is made of non-gross silver plating is formed on the puffer cylinder 1 by way of a thin copper plating film having a thickness of 1 μm or less. On the other hand, the finger contact 2 is generally made of copper, and the hard silver plating film 4 which is made of a gross silver plating is formed on the finger contact 2 by immersing the finger contact 2 into a silver plating bath which contains any one of gross agents (1) to (7) previously listed.

When members having different hardnesses slide relative to each other, the wear of the soft member having the low hardness progresses and the hard member having the high hardness is hardly worn. Accordingly, with respect to the slide contact portions 1*a*, 2*a* according to the embodiment of the present invention, the wear of the soft silver plating film 3 which is formed on the surface of the puffer cylinder 1 progresses mainly, and the hard silver plating film 4 which is formed on the surface of the finger contact 2 is hardly worn. Accordingly, with respect to the thicknesses of the respective plating films, the soft silver plating film 3 is required to possess a thickness which is substantially equal to a conventional soft silver plating film, it is possible to reduce the thickness of the hard silver plating film 4 which is hardly worn.

To confirm advantageous effects of the embodiment 1 of the present invention, a slide test is carried out using the constitution shown in FIG. 2. Here, With respect to the hardness of the plating film, Vickers hardness of the soft film is Hv70 to 80 and the hardness of the hard film is Hv140 to 160. Further, the thickness of the soft plating film is set equal to the thickness of the soft plating film of the related art, while the thickness of the hard plating film is set to one half of the soft plating film. The slide test is carried out 10,000 times under the same atmosphere, the same face pressure and the same slide speed as an actual machine.

As a result of the observation of a worn-out state after the test, it is found that the wear was remarkable in the soft film and the most of the plating film is eliminated due to the wear, while the wear of the hard film is small and the hard film having a plating thickness which is one half of the initial plating thickness still remains. Further, when the contact resistance is measured by a fall-of-potential method with a supply current set at 100 A, as a result, it is found that the resistance change falls within an allowable range and the increase of the contact resistance attributed to the wear is not observed.

Here, in this embodiment 1, the soft silver plating film 3 is formed on the surface of the puffer cylinder 1, and the hard silver plating film 4 is formed on the surface of the finger contact 2. However, even when the hard silver plating film 4 is formed on the surface of the puffer cylinder 1 and the soft silver plating film 3 is formed on the surface of the finger contact 2, it is possible to obtain substantially equal advantageous effects.

As an example of the present invention which is actually put into practice, it is possible to name the puffer cylinder 1 and the finger contact 2 which constitute a slide portion of a gas insulated breaker which uses an $SF_6$ gas as an insulating medium.

According to the embodiment 1 of the present invention, in the gas insulated breaking device which accommodates, in the inside of the conductive vessel formed of a grounded tank 12 in which the insulation gas such as $SF_6$ or the like is sealed, open/close elements including the puffer cylinder which compresses the insulation gas such as $SF_6$ and extinguishes an arc and the power supply means formed of the finger contact 2 which includes the slide contact portion which is brought into slide contact with the slide contact portion 1*a* of the puffer cylinder 1. In such a gas insulated breaking device, the silver plating films which are formed on the slide contact portion 1*a* of the puffer cylinder 1 and the silver plating film which is formed on the slide contact portion 2*a* of the electricity supply means formed of the finger contact 2 are respectively constituted of silver plating films 3, 4 which have hardnesses different from each other. Accordingly, by constituting the silver plating film which is formed on the slide contact portion 1*a* of the puffer cylinder 1 and the silver plating film which is formed on the slide contact portion 2*a* of the electricity supply means formed of the finger contact 2 which supplies electricity to the puffer cylinder using the silver plating films 3, 4 which differ in hardness from each other, it is possible to provide the gas insulated breaking device which can optimize the measure to cope with the wear.

Further, according to the embodiment 1 of the present invention, in the above-mentioned constitution, the relatively soft silver plating film 3 is formed on the slide contact portion 1*a* of the puffer cylinder 1, and the relatively hard silver plating film 4 is formed on the slide contact portion 2*a* of the electricity supply means formed of the finger contact 2. Accordingly, by constituting the silver plating film which is formed on the slide contact portion 1*a* of the puffer cylinder using the relatively soft silver plating film 3 and by constituting the silver plating film which is formed on the slide contact portion 2*a* of the electricity supply means formed of the finger contact 2 which supplies electricity to the puffer cylinder 1 using the relatively hard silver plating film 4, it is possible to obtain the gas insulated breaking device which can optimize the measure to cope with the wear.

Further, according to the embodiment 1 of the present invention, in the above-mentioned constitution, with respect to the silver plating films, the thickness of the relatively hard plating film 4 is set to 20% to 60% of the thickness of the relatively soft plating film 3 and hence, the silver plating film 3 which is formed on the slide contact portion 1*a* of the puffer cylinder 1 and the silver plating film 4 which is formed on the slide contact portion 2*a* of the electricity supply means formed of the finger contact 2 which supplies electricity to the puffer cylinder 1 can be formed by using the plating films having predetermined hardness which differ in hardness from each other whereby it is possible to provide the gas insulated breaking device which can optimize the measure to cope with the wear.

Further, according to the embodiment 1 of the present invention, in the above-mentioned constitution, with respect to the Vickers hardnesses of the silver plating films, the Vickers hardness of either one of the plating films is set Hv80 or less and the hardness of another plating film is set to Hv100 or more and hence, the silver plating film 3 which is formed on the slide contact portion 1*a* of the puffer cylinder 1 and the silver plating film 4 which is formed on the slide contact portion 2*a* of the electricity supply means formed of the finger contact 2 which supplies electricity to the puffer cylinder 1 can be formed by using the plating films having predetermined thicknesses which differ in hardness from each other whereby it is possible to provide the gas insulated breaking device which can optimize the measure to cope with the wear.

According to the embodiment 1 of the present invention, constitutions described in following paragraphs (1) to (3) can be respectively proposed.

(1) The gas insulated breaker which accommodates the breaker portion in the inside of the grounded tank in which the insulation gas is sealed, wherein the silver plating films which are formed on the puffer cylinder having the slide contact portion and the slide contact portion of the finger contact are respectively constituted of the plating films having hardnesses different from each other.

(2) The gas insulated breaker according to the above-mentioned (1), wherein with respect to the silver plating films, the thickness of the hard plating film is set to 20% to 60% of the thickness of the soft plating film.

(3) The gas insulated breaker according to the above-mentioned (1), wherein Vickers hardness of either one of the silver plating films is Hv80 or less and the Vickers hardness of another one of the silver plating films is Hv100 or more.

In the embodiment of the present invention, since either one of the plating film of the puffer cylinder 1 and the plating film of the finger contact 2 selectively wears, by setting the wear-side plating film thick and the plating film which hardly wears thin, it is possible to optimize the thicknesses of plating films of the respective parts.

In the slide portion of the gas insulated breaker which includes the silver plating films according to the embodiment 1 of the present invention, the silver plating films which are formed on the slide contact portions 1*a*, 2*a* of the puffer cylinder 1 and the finger contact 2 having the slide contact portion are constituted of plating films which differ in hardness, wherein the soft silver plating film 3 having the low hardness has the large thickness, while the hard silver plating film 3 having the high hardness has the small thickness.

According to the embodiment 1 of the present invention, the slide contact portions 1*a*, 2*a* of the puffer cylinder 1 and the finger contact 2 having the slide contact portions of the gas insulated breaker are constituted of the silver plating films having harnesses different from each other, wherein the thickness of the soft silver plating film 3 which mainly wears by sliding is made thick and the thickness of the hard silver plating film 3 which hardly wears is made thin. Accordingly, the soft plating film 3 has the thickness which is determined in consideration of the wear by sliding, while the hard silver plating film 4 hardly wears and hence can be made thin.

Embodiment 2

Figure 3:
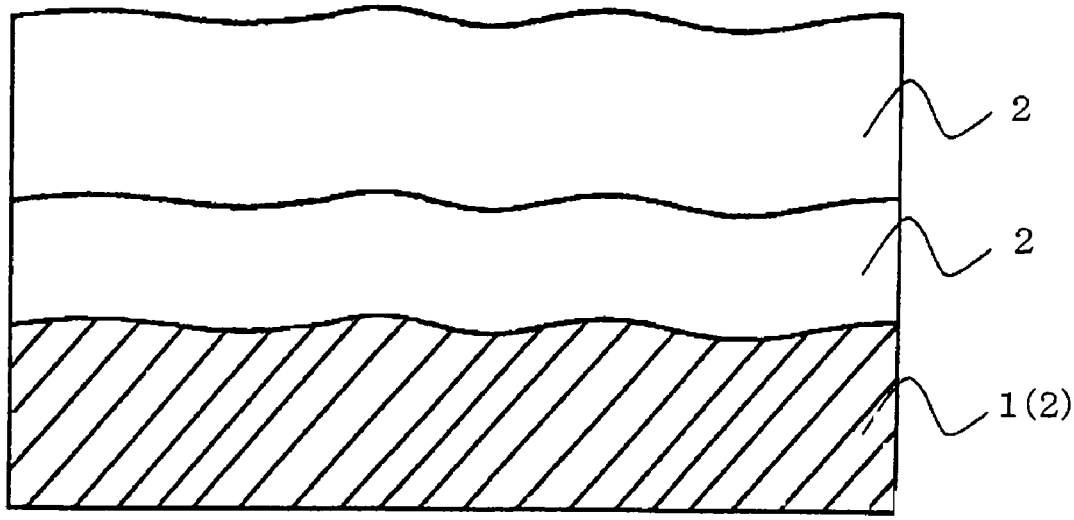
FIG. 3 is a cross-sectional view showing one example of the constitution of a slide portion of a gas insulated breaker according to the second embodiment of the present invention.
Figure 4:
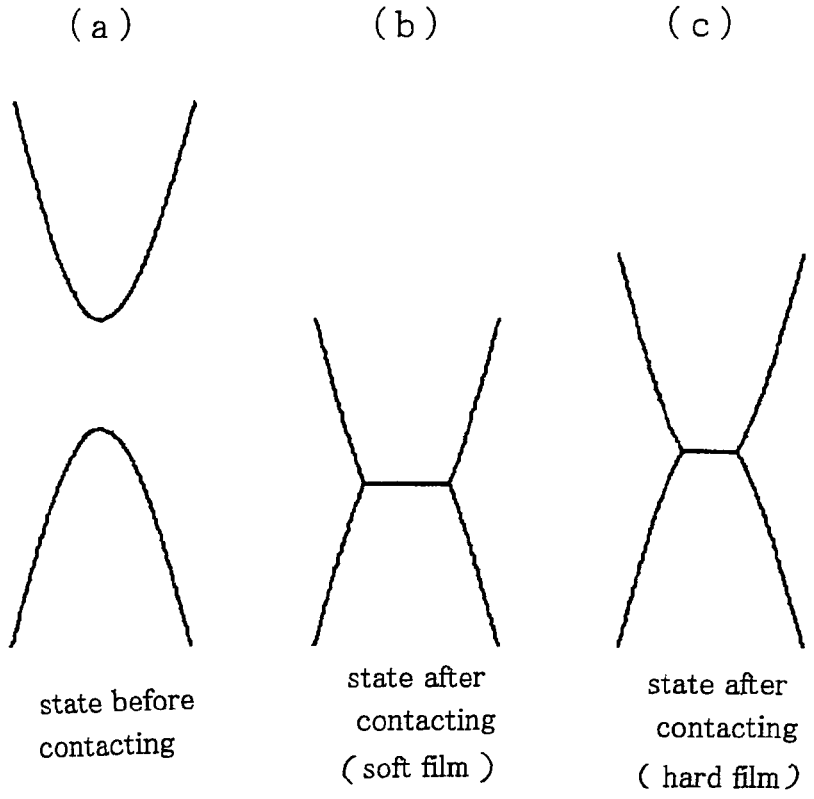
FIG. 4 is a schematic view which microscopically depicts an example of a contact state of a slide contact portion according to the second embodiment of the present invention.
Figure 5:
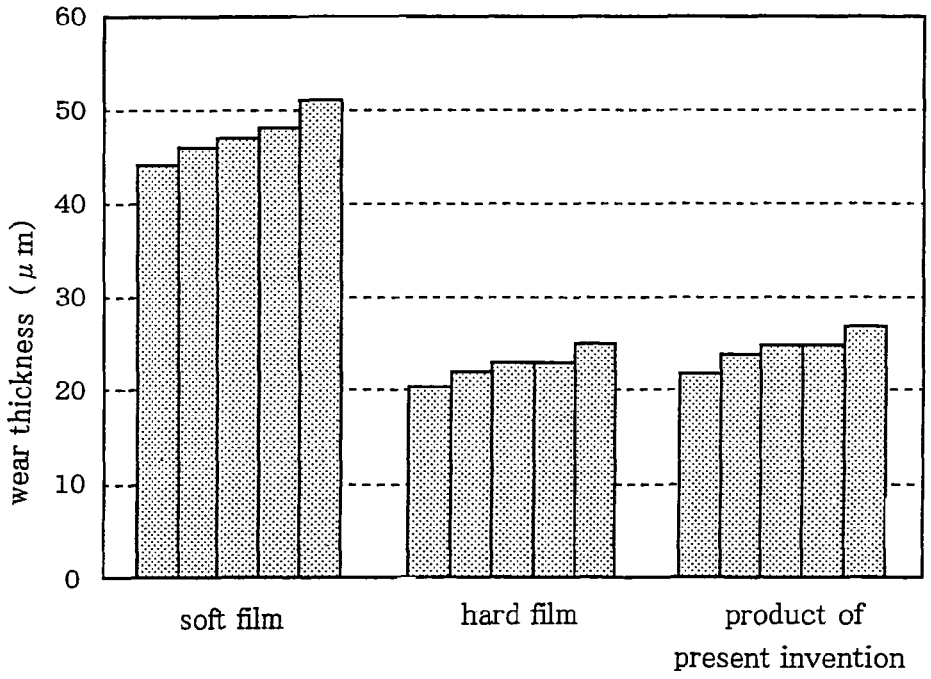
FIG. 5 is a diagram showing one example of evaluation result on wear characteristics of a silver plating film according to the second embodiment of the present invention.
Figure 6:
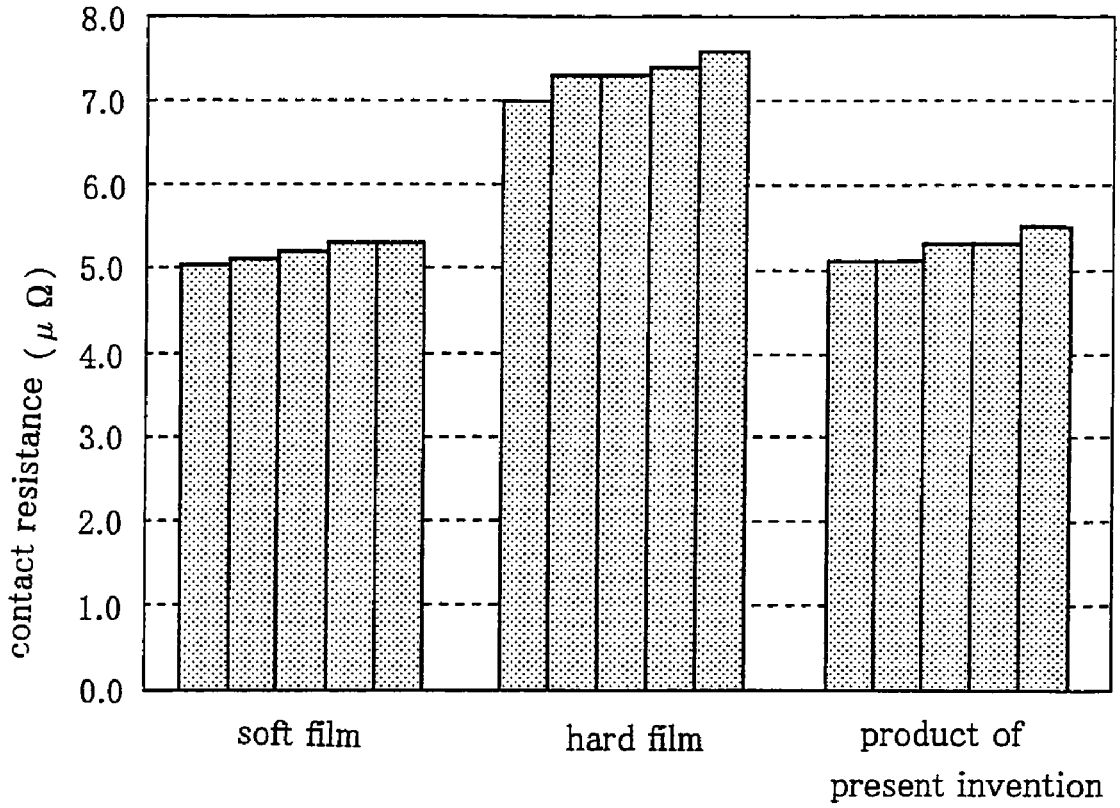
FIG. 6 is a diagram showing one example of evaluation result on contact resistance of the silver plating film according to the second embodiment of the present invention.

An embodiment 2 according to the present invention is explained in conjunction with FIG. 3 to FIG. 6. FIG. 3 is a cross-sectional view showing one example of the constitution of a slide portion of a gas insulated breaker according to the second embodiment of the present invention. FIG. 4 is a schematic view which microscopically depicts one example of a contact state of a slide contact portion. FIG. 5 is a diagram showing one example of evaluation result on wear characteristics of a silver plating film according to the second embodiment of the present invention. FIG. 6 is a diagram showing one example of evaluation result on contact resistance of the silver plating film according to the second embodiment of the present invention. FIG. 2 which is described previously is also a side view which shows the constitution of one example of a puffer type gas insulated breaking device which includes an arc-extinguishing chamber of a two-directional blow method to which the second embodiment of the present invention is applied.

In FIG. 3, on a surface of a base material 1(2) made of a conductor which constitutes a slide contact portion in a movable contact 19, a fixed contact 21, a puffer cylinder 1, a finger contact 2 and the like, a hard silver plating film is formed by way of a soft silver plating film. The base material 1(2) of the slide portion is generally made of aluminum. The soft silver plating film which is a non-gross silver plating is formed on the base material 1(2) by way of a thin copper plating film having a thickness of 1 μm or less. Thereafter, by immersing the soft silver plating in a silver plating bath which contains any one of gross agents (1) to (7) previously listed.

Here, the hardness of the plating films are generally evaluated based on Vickers hardness, wherein Hv70 to 80 is used as the hardness of the soft silver plating film and the Hv140 to 160 is used as the hardness of the hard silver plating film.

With respect to functions of two kinds of silver plating films which differ in hardness, the hard film which is formed on the surface exhibits a function of restring wear attributed to sliding and the soft film which is formed on the inside exhibits a plastic deformation effect whereby a favorable electrical contact state can be realized. With respect to the slide characteristic, the surface of the slide portion includes the hard silver plating film and hence, the surface of the slide portion exhibits the excellent wear resistance whereby the wear of the silver plating film attributed to the sliding is reduced and it is also possible to obtain an advantageous effect that the generation of wear powder can be suppressed.

FIG. 4 is a schematic view which depicts one example of the contact state of the slide portion microscopically. In general, when two surfaces are brought into contact with each other, fine projections which are present on the respective surfaces are brought into contact with each other and these fine projections are subject to the plastic deformation in response to pressing. The magnitude of the plastic deformation is controlled by a pressing pressure and hardnesses of members which are brought into contact with each other, wherein the plastic deformation of the soft film is larger than the plastic deformation of the hard film and a contact area of the soft film becomes larger than a contact area of the hard film. Since the contact resistance is controlled by the contact area, the contact resistance of the soft film having the large contact area is decreased.

On the other hand, with respect to the sliding, the hard film is advantageous to the contrary. The reason that the silver plating film is used in the slide portion of the gas insulated breaker is that the silver plating film is originally soft and hence, is subject to large plastic deformation when the film is pushed whereby it is possible to expect an advantageous effect that the contact resistance is reduced.

FIG. 5 shows an evaluation result on wear characteristics of the silver plating films according to the second embodiment of the present invention. For evaluating the wear characteristics, a slide test corresponding to a slide distance obtained by repeating sliding 10,000 times is performed using a pin-on-disc device at a slide speed and a pressure equal to a slide speed and a pressure of the slide portion in the gas insulated breaker and, thereafter, wear thicknesses of the silver plating films after the test are measured.

It is evident from FIG. 5 that the wear thickness of the silver plating film in the embodiment 2 of the present invention is 30μ or less which is approximately one half of the wear thickness of the soft film and hence, the wear thickness is substantially equal to the wear thickness of the hard film.

On the other hand, with respect to the electric contact state, due to the plastic deformation of the inner soft film, it is possible to suppress the contact resistance at a low value. As mentioned previously, although the contact resistance is controlled by the contact area, the silver plating film of the embodiment 2 of the present invention includes the soft film on the inner side thereof, wherein the soft film is plastically deformed when pressed. Accordingly, the silver plating film can obtain the sufficient contact area thus capable of lowering the contact resistance.

FIG. 6 shows evaluation result on the contact resistance of the silver plating film according to the embodiment 2 of the present invention. A test model having the inner structure similar to the inner structure of the gas insulated breaker is manufactured, and the contact resistance under a condition that the supply current is 100 A is measured using a fall-of-potential method.

From FIG. 6, it is evident that the contact resistance of the silver plating film of the embodiment 2 of the present invention is 5.0 to 5.5 μΩ which is approximately 70% of the contact resistance of the hard film and hence, the contact resistance of the embodiment 2 of the present invention is substantially equal to the contact resistance of the soft film.

Accordingly, with the use of two kinds of silver plating films which are different in hardness from each other, the hard film formed on the surface suppresses the wear attributed to the sliding and the soft film formed on the inner side establishes the favorable electric contact state due to the plastic deformation effect thereof and hence, it is possible to obtain the slide portion of the gas insulated breaker which possesses the wear characteristics substantially at the same level as the hard film and the electric contact state substantially at the same level as the soft film.

Here, by applying the binder made of perfluoropolyether and graphite described in the related art or an organic lubricant material such as oil or grease to the surface of the silver plating film of the present invention, the lubrication performance is further enhanced and hence, the wear can be reduced. Particularly, with respect to generation of abnormal heat attributed to the overcurrent described in the related art, due to the combined use of two kinds of silver plating films and the above-mentioned lubrication material, it is possible to suppress the generation of abnormal heat.

As an application example of the second embodiment of the present invention, the movable contact which constitutes the slide portion of the gas insulated breaker which uses a $SF_6$ gas as the insulating medium or the like, the fixed contact, the puffer cylinder, the finger contact can be named.

According to the embodiment 2 of the present invention, in the gas insulated breaking device such as the gas insulated breaker which accommodates, in the inside of the electric conductive vessel made of the grounded tank 12 in which the insulation gas such as $SF_6$ gas is sealed, open/close elements of the breaker portion having slide contact portions such as the movable contact 19, the fixing contact 21, the puffer cylinder 1, the finger contact 2, the silver plating film which is formed in the slide contact portion is constituted of a plurality of plating films which differ in hardness and hence, it is possible to acquire the gas insulated breaking device which includes the slide contact portion capable of maintaining a favorable slide state while realizing the favorable electric contact state.

Further, according to the embodiment 2 of the present invention, in the above-mentioned constitution, the silver plating film has the inner layer thereof formed of the soft film and the outer layer which constitutes a surface portion thereof formed of the hard film. In this manner, due to the silver plating film in which the inner layer is formed of the soft film and the outer layer which constitutes the surface portion is formed of the hard film, it is possible to acquire the gas insulated breaking device which includes the slide contact portion capable of maintaining a favorable slide state while realizing the favorable electric contact state.

Further, according to the embodiment 2 of the present invention, in the above-mentioned constitution, the Vickers hardness of the silver plating film which constitutes the soft film 2 is set to Hv80 or less and the Vickers hardness of the silver plating film which constitutes the hard film 3 is set to Hv100 or more. In this manner, by properly setting the hardnesses of the soft film and the hard film, it is possible to acquire the gas insulated breaking device which includes the slide contact portion capable of maintaining a favorable slide state while realizing the favorable electric contact state.

In the embodiment 2 according to the present invention, the constitutions which are described in following paragraphs (1) to (3) are proposed.

(1) In the gas insulated breaker which accommodates the breaker portion in the inside of the grounded tank in which the insulation gas is sealed, the silver plating film which is formed on the movable contact having the slide contact portion, the fixing contact, the slide contact portion between the puffer cylinder and the finger contact is constituted of a plurality of plating films which differ in hardness.

(2) The gas insulated breaker described in the above-mentioned paragraph (1) in which the silver plating film has the inner layer thereof formed of the soft film and the outer (surface) layer formed of the hard film.

(3) The gas insulated breaker described in the above-mentioned paragraph (1) in which the Vickers hardness of the soft silver plating film is Hv80 or less and the Vickers hardness of the hard silver plating film is Hv100 or more.

The embodiment 2 according to the present invention acquires the slide portion of the gas insulated breaker which includes the silver plating film which satisfies both of functions which are contradictory to each other, that is, the realization of the favorable electric contact state and the maintenance of the favorable slide state.

The slide portion of the gas insulated breaker which includes the silver plating film according to the second embodiment of the present invention forms the soft film on the base material of the slide portion and forms the hard film on the surface of the slide portion which is arranged outside the soft film.

According to the embodiment 2 of the present invention, since two kinds of silver plating films which differ in hardness are formed on the surface of the slide portion of the gas insulated breaker, the hard film which is formed on the surface exhibits the wear suppression function against the wear attributed to sliding and the favorable electric contact state is realized due to the plastic deformation effect arranged on the inner side of the silver plating film.

Further, the embodiment 2 of the present invention is also applicable to the previously-mentioned embodiment 1. That is, in the gas insulated breaking device according to the present invention which accommodates the open/close elements including the puffer cylinder which compresses the insulation gas and extinguishes the arc and the electricity supply means which has the slide contact portion of the puffer cylinder in the inside of the vessel in which the insulation gas is sealed, the relatively soft plating film is formed on the slide contact portion of the puffer cylinder and the relatively hard plating film is formed on the slide contact portion of the electricity supply means and, at the same time, the silver plating film of each slide contact portion has the inner layer thereof formed of the soft film and the outer layer which constitutes a surface portion formed of the hard film.

While the presently preferred embodiments of the present invention have been shown and described. It is to be understood that these disclosures are for the purpose of illustration and that various changes and modifications may be made without departing from the scope of the invention as set forth in the appended claims.

What is claimed is:

1. A puffer type gas insulated breaker used in a power system comprising:

a puffer cylinder which compresses an insulation gas and extinguishes an arc and which has a slide contact portion; and a contact finger which has a slide contact portion which may be brought into slide contact with the slide contact portion of the puffer cylinder in the inside of a vessel in which the insulation gas is sealed, wherein a relatively soft silver plating film is formed on the slide contact portion of the puffer cylinder and a relatively hard silver plating film, which is harder than the relatively soft silver plating film, is formed on the slide contact portion of the contact finger, wherein the thickness of the relatively hard silver plating film is less than the thickness of the relatively soft silver plating film, and wherein one of the relatively soft silver plating film and the relatively hard silver plating film is formed of an inner plating film and an outer plating film, the inner plating film being softer than the outer plating film.

2. The gas insulated breaking device according to claim 1, wherein the thickness of the relatively hard silver plating film is 20% to 60% of the thickness of the relatively soft silver plating film.

3. The gas insulated breaking device according to claim 1, wherein the Vickers hardness of the relatively soft silver plating film is Hv80 or less and the Vickers hardness of the relatively hard silver plating film is Hv100 or more.

4. The gas insulated breaking device according to claim 2, wherein the Vickers hardness of the relatively soft silver plating film is Hv80 or less and the Vickers hardness of the relatively hard silver plating film is Hv100 or more.

5. The gas insulated breaking device according to claim 1, wherein the relatively soft silver plating film is made of non-gross silver plating, and the relatively hard silver plating film is made of gross silver plating.

6. A puffer type gas insulated breaker used in a power system comprising:

open/close elements including a first slide contact portion configured to be brought into slide contact with a second slide contact portion in the inside of a vessel in which an insulation gas is sealed, wherein a silver plating film formed on one of the first and second slide contact portions is constituted of an inner layer thereof formed of a relatively soft silver plating film and an outer layer thereof which constitutes a surface portion formed of a relatively hard silver plating film which is harder than the relatively soft silver plating film.

7. The gas insulated breaking device according to claim 6, wherein the Vickers hardness of the relatively soft silver plating film is Hv80 or less and the Vickers hardness of the relatively hard silver plating film is Hv100 or more.

8. The gas insulated breaking device according to claim 6, wherein the relatively soft silver plating film is made of non-gross silver plating, and the relatively hard silver plating film is made of gross silver plating.

9. The gas insulated breaking device according to claim 6, wherein the wear thickness of the silver plating film is 30μ or less, and the thickness of the relatively hard silver plating is thicker than the wear thickness of the silver plating film.

* * * * *